US006012614A

United States Patent [19]

Stanford

[11] Patent Number: 6,012,614

[45] Date of Patent: Jan. 11, 2000

[54] TUCK POINTING APPARATUS

[76] Inventor: Morris Stanford, 780 Griggs Ave., Columbus, Ohio 43223

[21] Appl. No.: 09/156,087

[22] Filed: Sep. 17, 1998

[51] Int. Cl.[7] ..... B28C 5/06

[52] U.S. Cl. ..... 222/239; 222/334; 222/391; 239/144; 239/345; 366/13; 366/293

[58] Field of Search ..... 222/149, 151, 222/175, 236, 239, 326, 391, 608, 334; 239/144, 345, 346, 369; 366/13, 194, 293, 343

[56] References Cited

U.S. PATENT DOCUMENTS

| | | | |
|---|---|---|---|
| D. 368,215 | 3/1996 | Dye . | |
| 2,372,029 | 3/1945 | Stair . | |
| 2,942,860 | 6/1960 | Ridley | 366/13 |
| 3,871,583 | 3/1975 | Kellert . | |
| 4,092,046 | 5/1978 | Bombelli et al. | 222/194 |
| 5,054,658 | 10/1991 | Aronie . | |
| 5,385,274 | 1/1995 | Twyman . | |

*Primary Examiner*—Andres Kashnikow
*Assistant Examiner*—Nguyen Dinh

[57] ABSTRACT

A new tuck pointing apparatus for applying cement to joints between bricks. The inventive device includes a cement reservoir for receiving a quantity of cement. The reservoir has an interior, a closed top end, and an open bottom end that forms a bottom opening into the interior of the reservoir. A mixer portion has open upper and lower ends, an interior, a toothed flywheel that is disposed in the interior of the mixer portion, and a mixing shaft that is coupled to the toothed flywheel. The open upper end of the mixer portion is releasably coupled to the bottom end of the reservoir. The mixing shaft mixes cement in the interior of the mixer portion. A motor portion rotates the toothed flywheel thereby rotating the mixing shaft. A first air tube is in communication with a supply of air pressure and is also in communication with the interior of the mixer portion. The first air tube is for selectively injecting air into the interior of the mixer portion to drive the concrete out of the lower end of the mixer portion.

10 Claims, 7 Drawing Sheets

FIG. 13
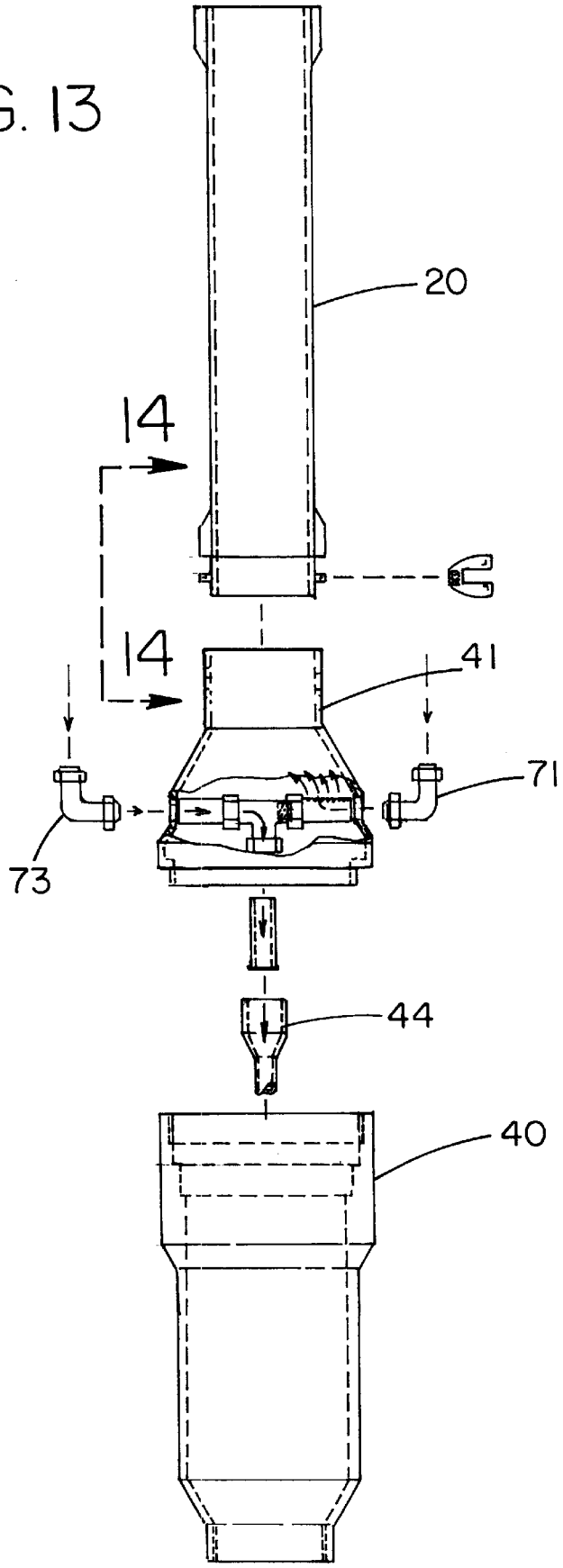
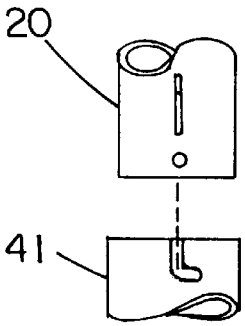
FIG. 14

TUCK POINTING APPARATUS

BACKGROUND OF THE INVENTION

1. Field of the Invention

The present invention relates to cement dispensers and more particularly pertains to a new tuck pointing apparatus for applying cement to joints between bricks.

2. Description of the Prior Art

The use of cement dispensers is known in the prior art. More specifically, cement dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art cement dispensers include U.S. Pat. Nos. 5,054,658; 5,385,274; 3,871,583; 4,092,046; Des. 368,215; and U.S. Pat. No. 2,372,029.

While these devices fulfill their respective, particular objectives and requirements, the aforementioned patents do not disclose a new tuck pointing apparatus. The inventive device includes a cement reservoir for receiving a quantity of cement. The reservoir has an interior, a closed top end, and an open bottom end that forms a bottom opening into the interior of the reservoir. A mixer portion has open upper and lower ends, an interior, a toothed flywheel that is disposed in the interior of the mixer portion, and a mixing shaft that is coupled to the toothed flywheel. The open upper end of the mixer portion is releasably coupled to the bottom end of the reservoir. The mixing shaft mixes cement in the interior of the mixer portion. A motor portion rotates the toothed flywheel thereby rotating the mixing shaft. A first air tube is in communication with a supply of air pressure and is also in communication with the interior of the mixer portion. The first air tube is for selectively injecting air into the interior of the mixer portion to drive the concrete out of the lower end of the mixer portion.

In these respects, the tuck pointing apparatus according to the present invention substantially departs from the conventional concepts and designs of the prior art, and in so doing provides an apparatus primarily developed for the purpose of applying cement to joints between bricks.

SUMMARY OF THE INVENTION

In view of the foregoing disadvantages inherent in the known types of cement dispensers now present in the prior art, the present invention provides a new tuck pointing apparatus construction wherein the same can be utilized for applying cement to joints between bricks.

The general purpose of the present invention, which will be described subsequently in greater detail, is to provide a new tuck pointing apparatus and method which has many of the advantages of the cement dispensers mentioned heretofore and many novel features that result in a new tuck pointing apparatus which is not anticipated, rendered obvious, suggested, or even implied by any of the prior art cement dispensers, either alone or in any combination thereof.

To attain this, the present invention generally comprises a cement reservoir for receiving a quantity of cement. The reservoir has an interior, a closed top end, and an open bottom end that forms a bottom opening into the interior of the reservoir. A mixer portion has open upper and lower ends, an interior, a toothed flywheel that is disposed in the interior of the mixer portion, and a mixing shaft that is coupled to the toothed flywheel. The open upper end of the mixer portion is releasably coupled to the bottom end of the reservoir. The mixing shaft mixes cement in the interior of the mixer portion. A motor portion rotates the toothed flywheel thereby rotating the mixing shaft. A first air tube is in communication with a supply of air pressure and is also in communication with the interior of the mixer portion. The first air tube is for selectively injecting air into the interior of the mixer portion to drive the concrete out of the lower end of the mixer portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tuck pointing apparatus apparatus and method which has many of the advantages of the cement dispensers mentioned heretofore and many novel features that result in a new tuck pointing apparatus which is not anticipated, rendered obvious, suggested, or even implied by any of the prior art cement dispensers, either alone or in any combination thereof.

It is another object of the present invention to provide a new tuck pointing apparatus which may be easily and efficiently manufactured and marketed.

It is a further object of the present invention to provide a new tuck pointing apparatus which is of a durable and reliable construction.

An even further object of the present invention is to provide a new tuck pointing apparatus which is susceptible of a low cost of manufacture with regard to both materials and labor, and which accordingly is then susceptible of low prices of sale to the consuming public, thereby making such tuck pointing apparatus economically available to the buying public.

Still yet another object of the present invention is to provide a new tuck pointing apparatus which provides in the apparatuses and methods of the prior art some of the advantages thereof, while simultaneously overcoming some of the disadvantages normally associated therewith.

Still another object of the present invention is to provide a new tuck pointing apparatus for applying cement to joints between bricks.

Yet another object of the present invention is to provide a new tuck pointing apparatus which includes a cement reservoir for receiving a quantity of cement. The reservoir has an interior, a closed top end, and an open bottom end that forms a bottom opening into the interior of the reservoir. A mixer portion has open upper and lower ends, an interior, a toothed flywheel that is disposed in the interior of the mixer portion, and a mixing shaft that is coupled to the toothed flywheel. The open upper end of the mixer portion is releasably coupled to the bottom end of the reservoir. The mixing shaft mixes cement in the interior of the mixer portion. A motor portion rotates the toothed flywheel thereby rotating the mixing shaft. A first air tube is in communication with a supply of air pressure and is also in communication with the interior of the mixer portion. The first air tube is for selectively injecting air into the interior of the mixer portion to drive the concrete out of the lower end of the mixer portion.

Still yet another object of the present invention is to provide a new tuck pointing apparatus that is portable.

Even still another object of the present invention is to provide a new tuck pointing apparatus that strikes the cement in the joints as the dispenser of the invention moves along the joint injecting cement.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 13 is a schematic exploded view of the present invention.

FIG. 14 is a schematic detailed view of the present invention taken from line 14—14 of FIG. 13.

DESCRIPTION OF THE PREFERRED EMBODIMENT

Figure 1:
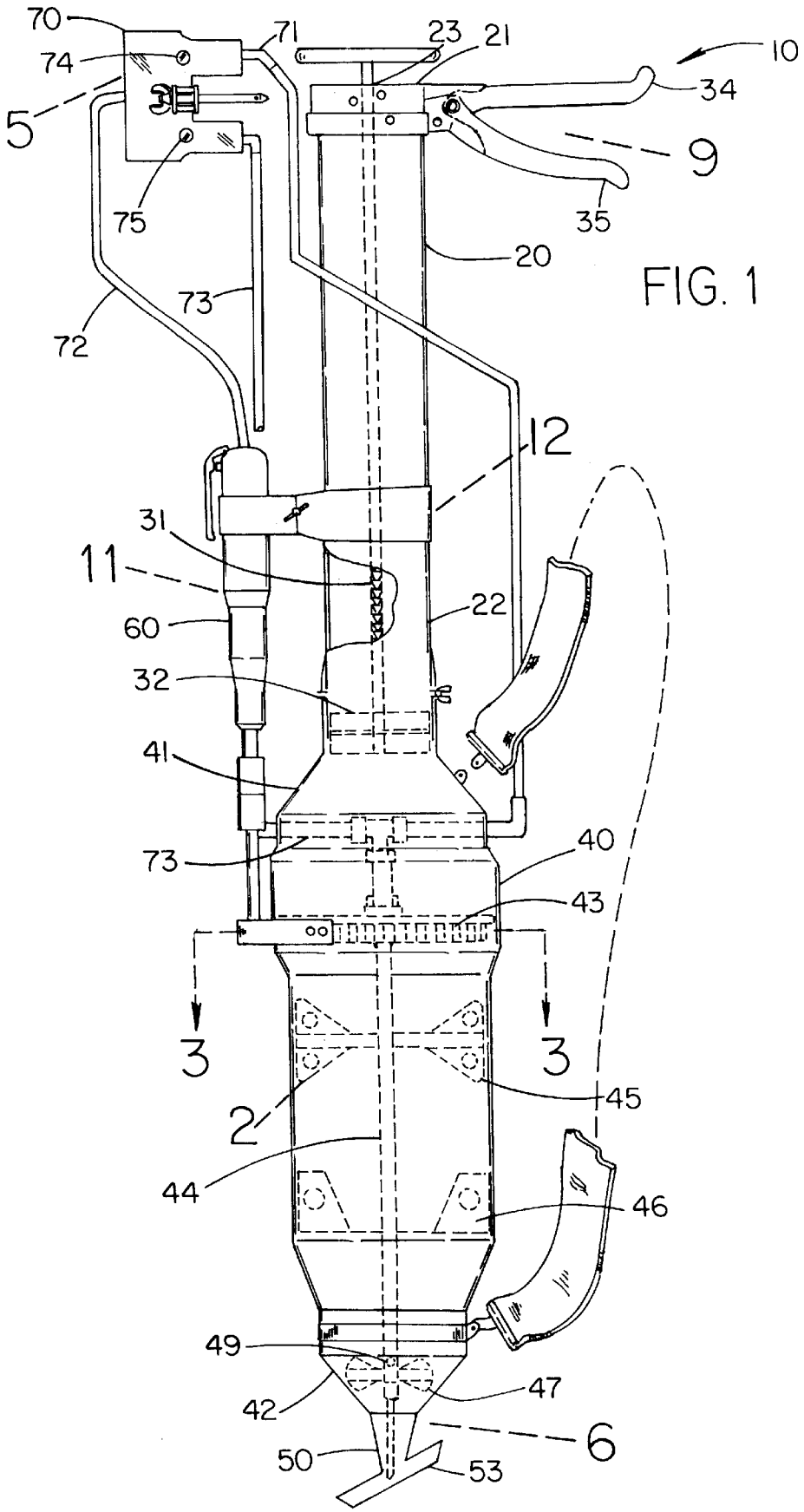
FIG. 1 is a schematic side view of a new tuck pointing apparatus according to the present invention.

With reference now to the drawings, and in particular to FIGS. 1 through 14 thereof, a new tuck pointing apparatus embodying the principles and concepts of the present invention and generally designated by the reference numeral 10 will be described.

As best illustrated in FIGS. 1 through 14, the tuck pointing apparatus 10 comprises a cement reservoir 20 for receiving a quantity of cement. The reservoir 20 has an interior, a closed top end 21, and an open bottom end 22 that forms a bottom opening into the interior of the reservoir 20. A mixer portion 40 has open upper and lower ends 41,42, an interior, a toothed flywheel 43 that is disposed in the interior of the mixer portion 40, and a mixing shaft 44 that is coupled to the toothed flywheel 43. The open upper end 41 of the mixer portion 40 is releasably coupled to the bottom end 22 of the reservoir 20, such as by a pin and slot combination, as shown in FIGS. 13 and 14. The mixing shaft 44 mixes cement in the interior of the mixer portion 40. A motor portion 60 rotates the toothed flywheel 43 thereby rotating the mixing shaft 44. A first air tube 71 is in communication with a supply of air pressure and is also in communication with the interior of the mixer portion 40. The first air tube 71 is for selectively injecting air into the interior of the mixer portion 40 to drive the concrete out of the lower end 42 of the mixer portion 40.

Figure 9:
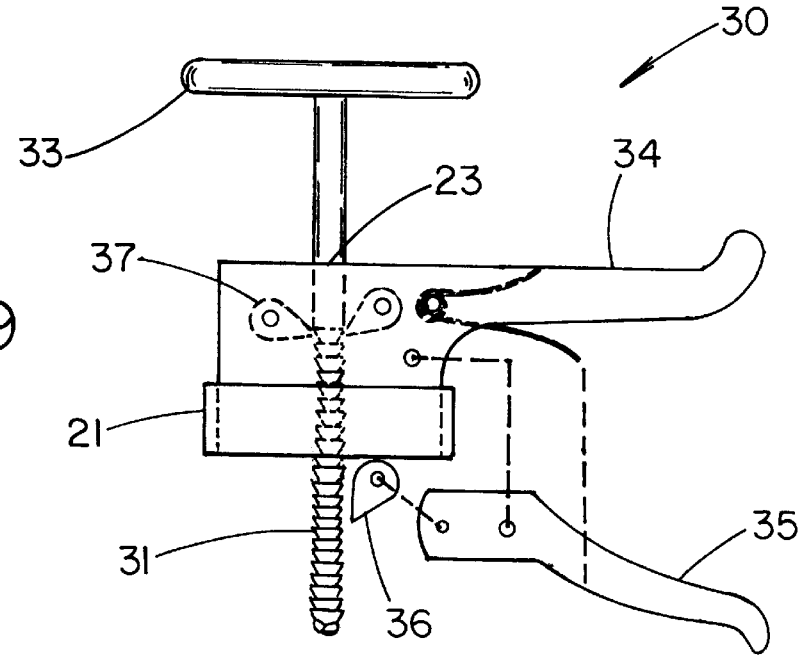
FIG. 9 is a schematic side view of a plunger mechanism of the present invention.

Preferably, the top end 21 of the reservoir 20 has a plunger mechanism 30 for pushing cement from the top end 21 of the reservoir 20 towards the bottom end 22 of the reservoir 20. An exemplary plunger mechanism 30 is shown in FIGS. 1 and 9 and has a wedged shaft 31 that has a pair of ends and extends through a plunger aperture 23 of the top end 21 of the reservoir 20. A plug member 32 is coupled to one end of the wedged shaft 31. A plunger handle 33 is coupled to another end of the wedged shaft 31. A top handle 34 extends from the top end 21 of the reservoir 20. A bottom handle 35 is pivotally coupled to the top end 21 of the reservoir 20. An engaging wedge 36 is pivotally coupled to the bottom handle 35 and engages the wedged shaft 31. A pair of safety wedges 37 engages the wedged shaft 31 for preventing the wedged shaft 31 from moving in a direction away from the bottom end 22 of the reservoir 20. Also included is a means (not shown) for releasing the engaging wedge 36 and the safety wedges 37 to permit the wedged shaft 31 to move away from the bottom end 22 of the reservoir 20.

Also preferably, the motor portion 60 is driven by air. A second air tube 72 is in communication with a supply of air pressure and is in communication with the motor portion 60 to providing air to the motor portion 60.

Ideally, the motor portion 60 is operatively coupled to the toothed flywheel 43 by a gearing system. As shown in FIG.

3, the gearing system has first, second, third, and fourth gears 61,62,63,64. The first gear 61 is coupled to the motor portion 60. The second gear 62 engages the first gear 61. The third gear 63 engages the second gear 62. The fourth gear 64 engages the third gear 63 and also engages the toothed flywheel 43. In the preferred embodiment, the first gear 61 has an outer diameter of ⅜", the second gear 62 has an outer diameter of ⅝", the third gear 63 has an outer diameter of ½", and the fourth gear 64 has an outer diameter of ¾".

Figure 2:
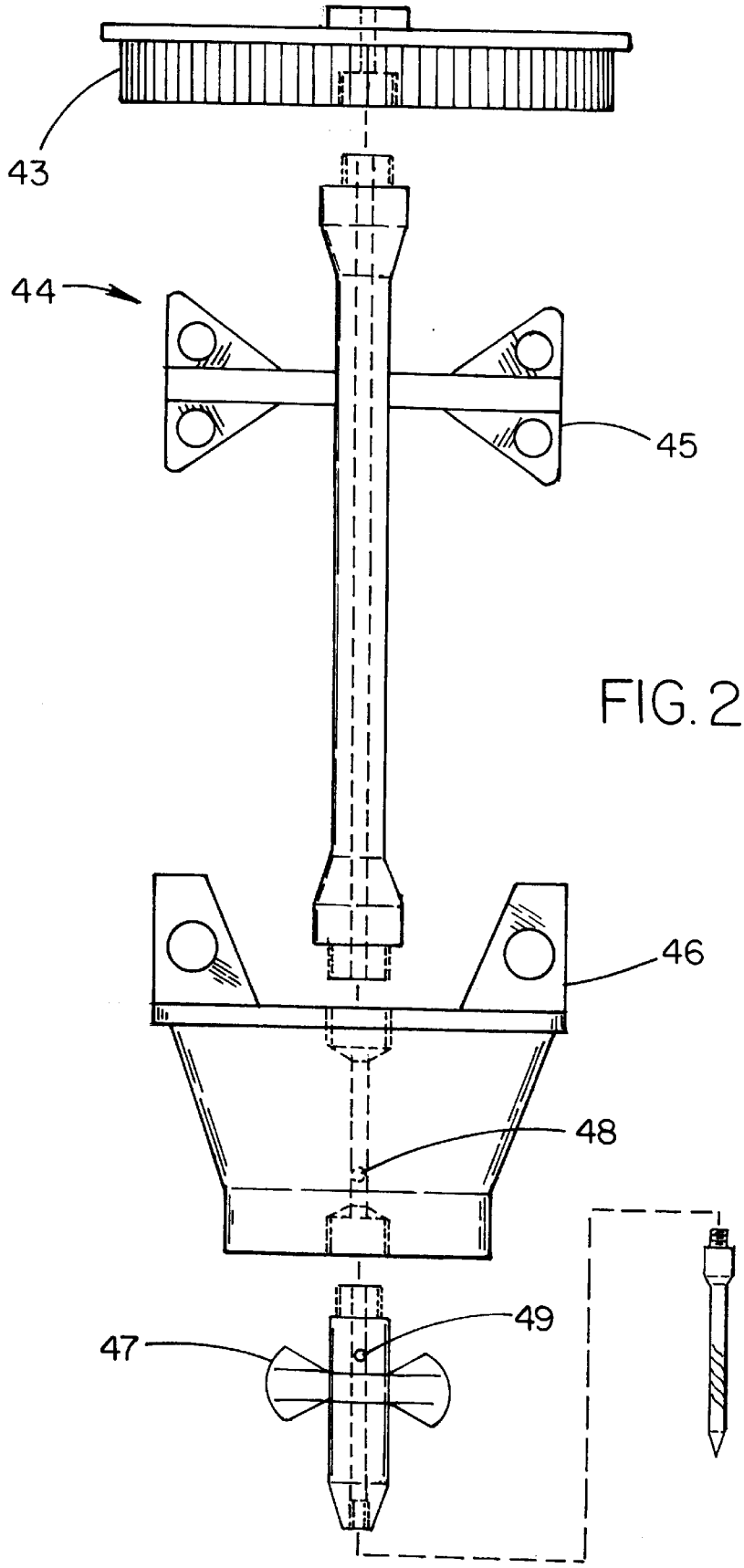
FIG. 2 is a schematic exploded view of a mixing shaft and flywheel of the present invention taken from line 2 of FIG. 1.
Figure 3:
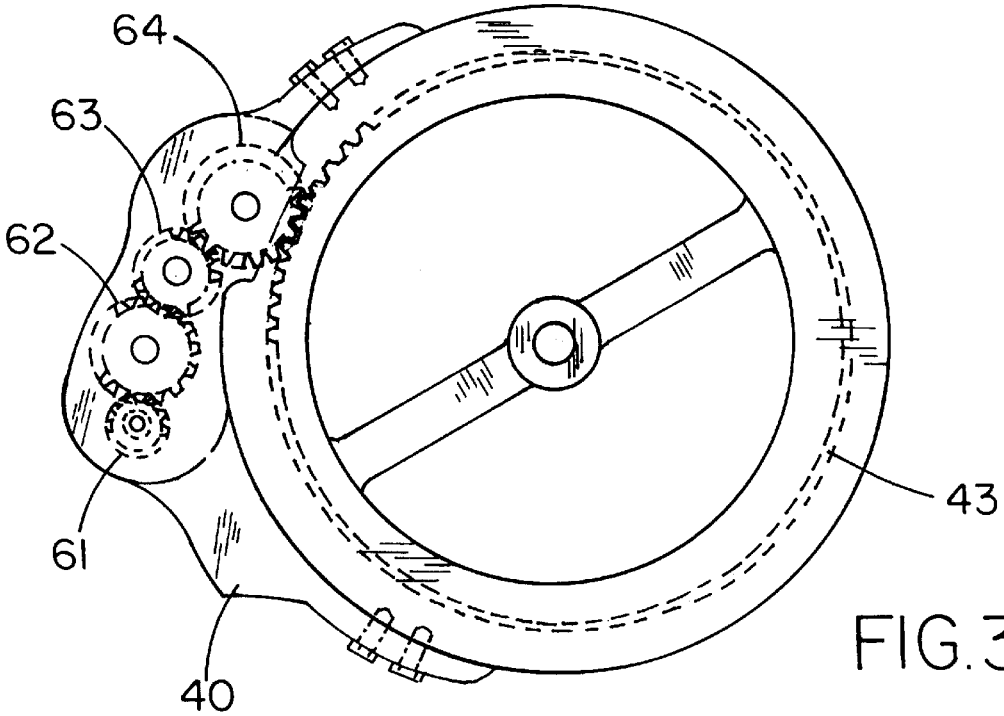
FIG. 3 is a schematic side view of a flywheel and gearing assembly of the present invention taken from line 3—3 of FIG. 1.

Preferably, as best illustrated in FIG. 2, the mixing shaft 44 of the mixer portion 40 has a pair of first mixing fins 45, a pair of second mixing fins 46, and a pair of third mixing fins 47 that extend from the mixing shaft 44 to mix cement in the interior of the mixer portion 40.

More preferably, as illustrated in FIGS. 1 and 2, the mixing shaft 44 of the mixer portion 40 is hollow. In such an embodiment, the mixing shaft 44 of the mixer portion 40 has a lumen. A third air tube 73 is in communication with a supply of air pressure and is in communication with the lumen of the mixing shaft 44 of the mixer portion 40. The third air tube 73 selectively provides air to the lumen of the mixing shaft 44. The mixing shaft 44 has a first hole 48 that extends into the lumen and is positioned towards the second mixing fins 46 and a second hole 49 that extends into the lumen and is positioned towards the third mixing fins 47. The holes permit injection of air into the interior of the mixer portion 40. The air mixes with the cement contained in the mixer portion 40 to loosen up the cement so that it doesn't clog up the dispensing portion 50.

Figure 4:
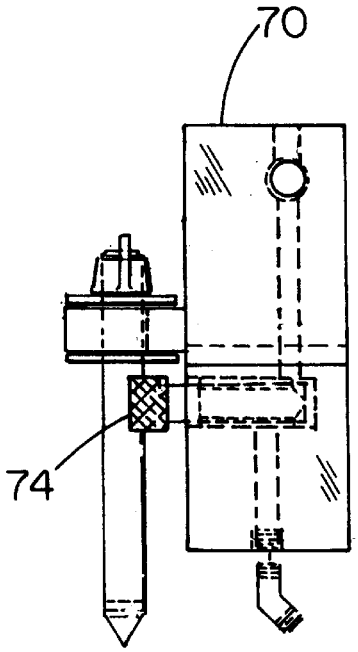
FIG. 4 is a schematic side view of a valve box of the present invention.
Figure 5:
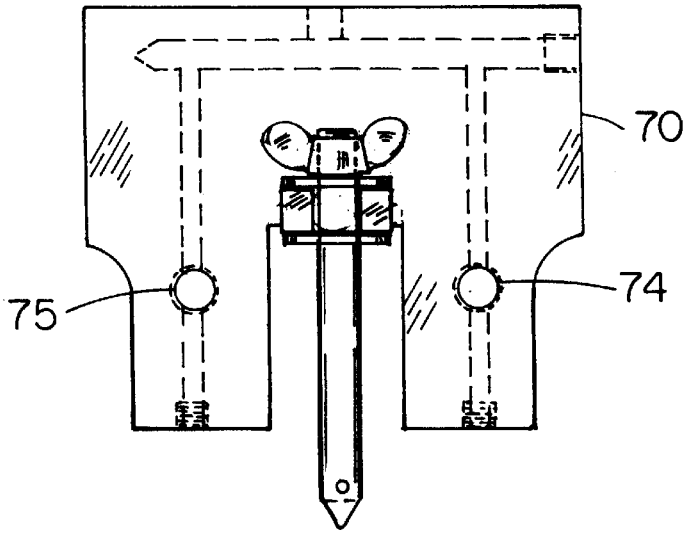
FIG. 5 is a schematic side view of a valve box of the present invention taken from line 5 of FIG. 1.
Figure 6:
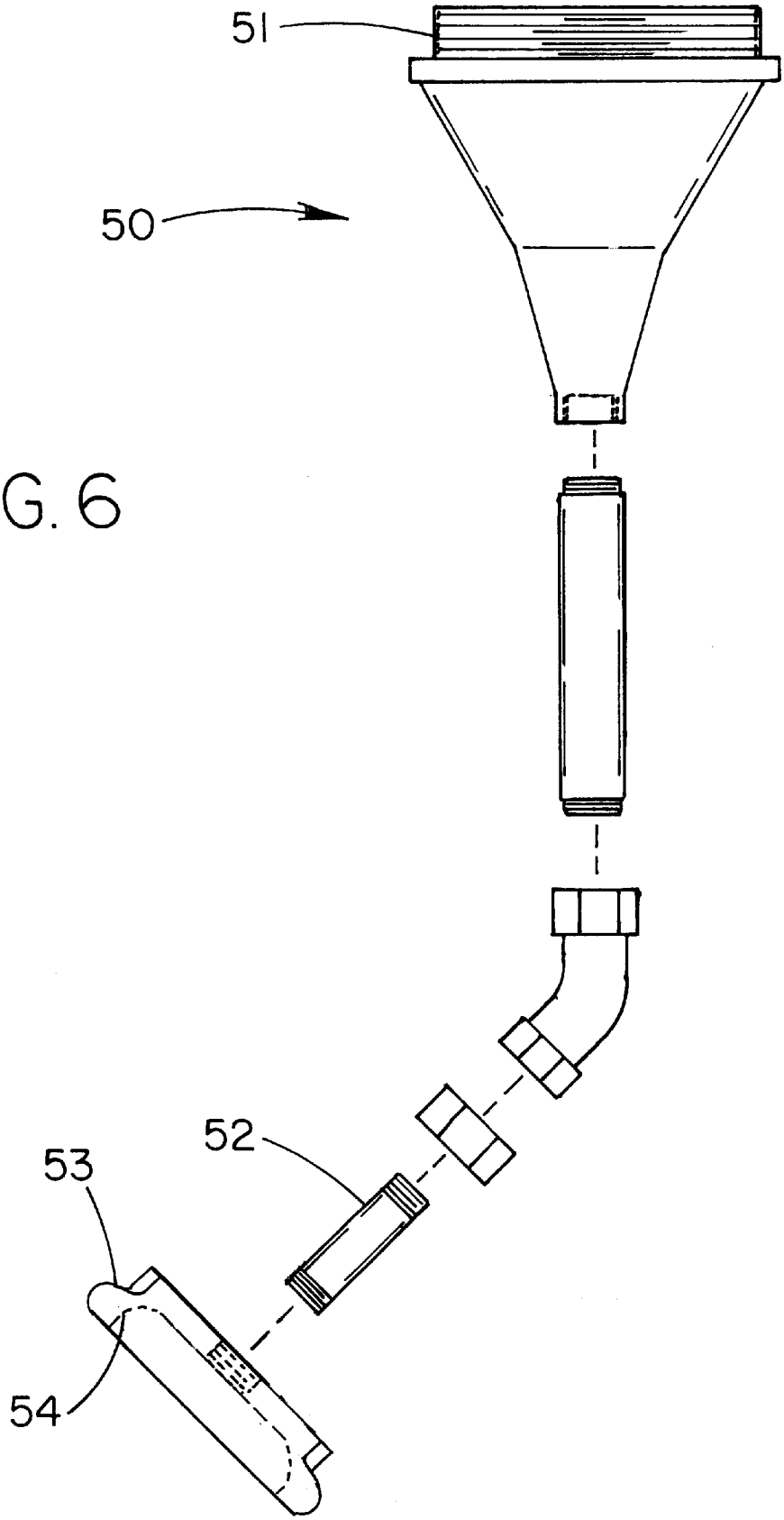
FIG. 6 is a schematic exploded view of a dispensing portion of the present invention taken from line 6 of FIG. 1.
Figure 7:
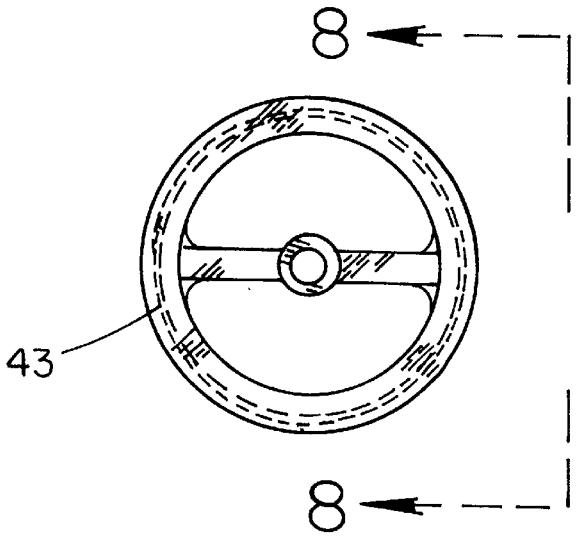
FIG. 7 is a schematic side view of a flywheel of the present invention.
Figure 8:
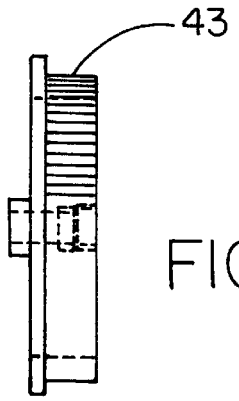
FIG. 8 is a schematic side view of a flywheel of the present invention taken from line 8—8 of FIG. 7.

Ideally, a valve box 70 is coupled to a supply of air pressure. In such an embodiment, as shown in FIGS. 1, 4 and 5, the first air tube 71 extends between the valve box 70 and the mixer portion 40. A first valve 74 of the valve box 70 selectively releases air into the first air tube 71. The second air tube 72 extends between the valve box 70 and the motor portion 60. A second valve (not shown) of the valve box 70 selectively releases air into the second air tube 72. The third air tube 73 extends between the valve box 70 and the mixing shaft 44. A third valve 75 of the valve box 70 selectively releases air into the third air tube 73.

Preferably, an open first end 51 of a dispensing portion 50 is coupled to the lower end 42 of the mixer portion 40. Cement is expelled from an open second end 52 of the dispensing portion 50. Ideally, the second end 52 of the dispensing portion 50 has a hollow dispensing head 53 coupled thereto. The hollow dispensing head 53 has a slot 54 therein that permits passage of cement therethrough and strikes the cement as the dispensing head 53 moves along a joint between bricks. Most ideally, the dispensing portion 50 rotates such that the user may apply cement to both horizontal and vertical joints without significantly twisting the machine.

Figure 10:
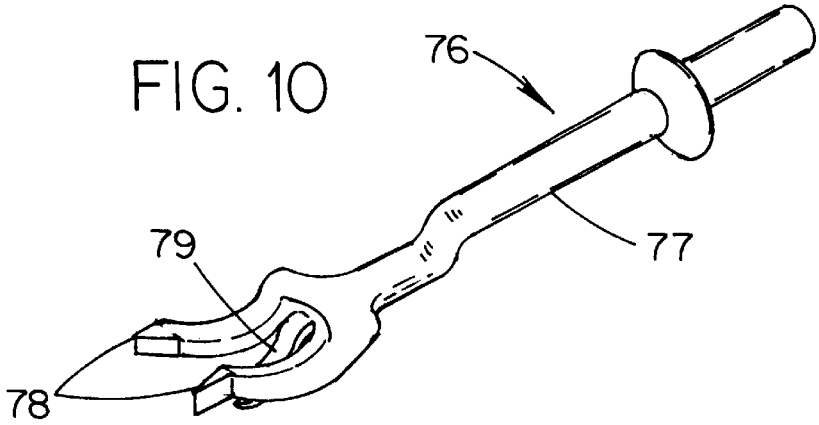
FIG. 10 is a schematic perspective view of a fork member for use in conjunction with the present invention.
Figure 11:
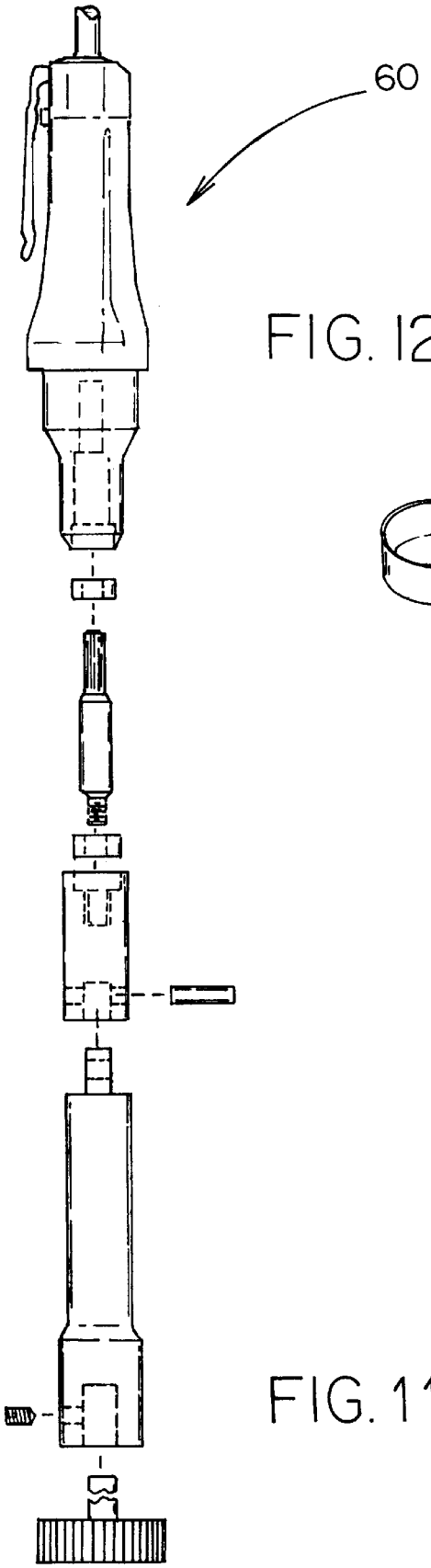
FIG. 11 is a schematic exploded view of a motor portion of the present invention taken from line 11 of FIG. 7.
Figure 12:
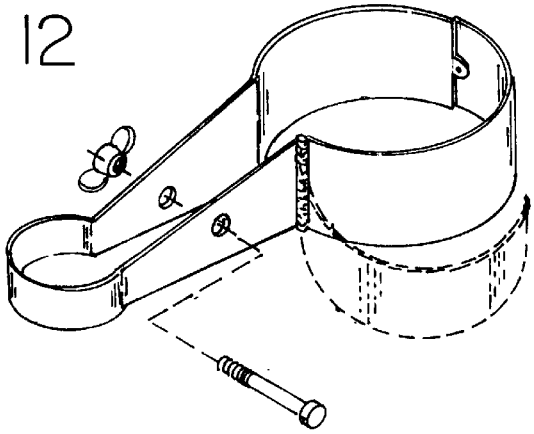
FIG. 12 is a schematic perspective view of a clamp of the present invention taken from line 12 of FIG. 1.

Preferably, the tuck pointing apparatus 10 is used in combination with a fork member 76 that removes cement from joints between bricks. As shown in FIG. 10, the fork member 76 has an elongate shaft portion 77, a pair of elongate finger guide portions that extend from the shaft portion 77, and an elongate scraping finger portion 79 that extends from the shaft portion 77. The scraping finger portion 79 is positioned between the spaced apart finger guide portions 78 and extends below a plane defined across longitudinal axes of the finger guide portions 78. The scraping finger portion 79 removes cement from the joints between bricks as the finger guide portions 78 slide along an outer surface of the bricks. An air hammer (not shown) attaches to the shaft portion 77 of the fork member 76 opposite the finger guide portions 78 to vibrate the fork member 76.

In use, the cement reservoir 20 is separated from the mixer portion 40. The plunger handle 33 of the plunger mechanism 30 is pulled away from the reservoir 20 to move the plug member 32 of the plunger mechanism 30 towards the top end 21 of the reservoir 20. The reservoir 20 is filled with cement and then recoupled to the mixer portion 40. Squeezing the top and bottom handle 35s of the plunger mechanism 30 towards each other drives the wedged shaft 31 towards the bottom end 22 of the reservoir 20, thereby pushing cement out of the reservoir 20 and into the mixer portion 40. The motor portion 60 rotates the toothed flywheel 43, which rotates the mixing shaft 44. The first valve 74 is opened to permit air to flow through the first air tube 71 and into the interior of the mixer portion 40. The resultant air pressure in the interior of the mixer portion 40 forces the cement out of the dispensing head 53 of the dispensing portion 50 and into a joint between bricks. The dispensing head 53 is moved along the joint to fill the joint and strike the cement as it moves. If the cement in the mixer portion 40 becomes difficult to dispense due to high viscosity, the third valve 75 is opened momentarily to permit air to flow through the third air tube 73 and into the lumen of the mixing shaft 44. The air passes through the first and second hole 49s in the mixing shaft 44 and into the interior of the mixer portion 40, where the air mixes with the cement and lowers its viscosity.

If cement is being replaced, the scraping finger 79 of the fork member 76 is inserted in a joint and the air hammer is turned on. The fork member 76 is slid along an outer surface of the bricks and the scraping finger 79 removes cement from the joint. Then the joint is filled with cement using the tuck pointing apparatus 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tuck pointing apparatus for applying cement to joints between bricks, said tuck pointing apparatus comprising:

a cement reservoir for receiving a quantity of cement, said reservoir having an interior, a closed top end, and an open bottom end forming a bottom opening into said interior of said reservoir;

a mixer portion having open upper and lower ends, an interior, a toothed flywheel being disposed in said interior of said mixer portion, and a mixing shaft being coupled to said toothed flywheel, said open upper end of said mixer portion being releasably coupled to said bottom end of said reservoir, said mixing shaft being for mixing cement in said interior of said mixer portion;

a motor portion being in communication with said toothed flywheel, said motor portion being for rotating said toothed flywheel; and a first air tube being in communication with a supply of air pressure and being in communication with said interior of said mixer portion, said first air tube being for selectively injecting air into said interior of said mixer portion.

2. The tuck pointing apparatus of claim 1, wherein said top end of said reservoir having a plunger mechanism for pushing cement from said top end of said reservoir towards said bottom end of said reservoir.

3. The tuck pointing apparatus of claim 2, wherein said top end of said reservoir has a plunger aperture extending therethrough, said plunger mechanism including a wedged shaft having a pair of ends and extending through said plunger aperture of said top end, a plug member being coupled to one end of said wedged shaft, a plunger handle being coupled to another end of said wedged shaft, a top handle being extended from said top end of said reservoir, a bottom handle being pivotally coupled to said top end of said reservoir, an engaging wedge being pivotally coupled to said bottom handle and engaging said wedged shaft, a pair of safety wedges engaging said wedged shaft for preventing said wedged shaft from moving in a direction away from said bottom end of said reservoir, and a means for releasing said engaging wedge and said safety wedges, wherein squeezing said top and bottom handles of said plunger mechanism towards each other drives said wedged shaft towards said bottom end of said reservoir.

4. The tuck pointing apparatus of claim 1, further comprising a second air tube being in communication with a supply of air pressure and being in communication with said motor portion for providing air to said motor portion, said motor portion being driven by air.

5. The tuck pointing apparatus of claim 1, wherein said mixing shaft of the mixer portion has a pair of first mixing fins, a pair of second mixing fins, and a pair of third mixing fins being extended therefrom for mixing cement in said interior of said mixer portion.

6. The tuck pointing apparatus of claim 5, wherein said mixing shaft of the mixer portion is hollow, said mixing shaft of said mixer portion having a lumen, a third air tube being in communication with a supply of air pressure and being in communication with said mixing shaft of said mixer portion, said third air tube being for selectively providing air to said lumen of said mixing shaft, said mixing shaft having a first hole extending into said lumen and being positioned towards said second mixing fins and a second hole extending into said lumen and being positioned towards said third mixing fins, said holes being for injecting air into said interior of said mixer portion.

7. The tuck pointing apparatus of claim 1, wherein said mixing shaft of the mixer portion is hollow, said mixing shaft of said mixer portion having a lumen, a third air tube being in communication with a supply of air pressure and being in communication with said mixing shaft of said mixer portion, said third air tube being for selectively providing air to said lumen of said mixing shaft, said mixing shaft having a first hole extending into said lumen, said hole being for injecting air into said interior of said mixer portion.

8. The tuck pointing apparatus of claim 1, further comprising a dispensing portion having open first and second ends, said first end of said dispensing portion being coupled to said lower end of said mixer portion.

9. The tuck pointing apparatus of claim 8, wherein said second end of said dispensing portion has a hollow dispensing head coupled thereto, said hollow dispensing head having a slot therein.

10. A tuck pointing apparatus for applying cement to joints between bricks, said tuck pointing apparatus comprising:

a cement reservoir for receiving a quantity of cement, said reservoir having an interior, a closed top end, and an open bottom end forming a bottom opening into said interior of said reservoir, said top end having a plunger aperture extending therethrough;

said top end of said reservoir having a plunger mechanism for pushing cement from said top end of said reservoir towards said bottom end of said reservoir, said plunger mechanism having a wedged shaft having a pair of ends and extending through said plunger aperture of said top end, a plug member being coupled to one end of said wedged shaft, a plunger handle being coupled to another end of said wedged shaft, a top handle being extended from said top end of said reservoir, a bottom handle being pivotally coupled to said top end of said reservoir, an engaging wedge being pivotally coupled to said bottom handle and engaging said wedged shaft, a pair of safety wedges engaging said wedged shaft for preventing said wedged shaft from moving in a direction away from said bottom end of said reservoir, and a means for releasing said engaging wedge and said safety wedges;

wherein squeezing said top and bottom handles of said plunger mechanism towards each other drives said wedged shaft towards said bottom end of said reservoir;

a mixer portion having open upper and lower ends, an interior, a toothed flywheel being disposed in said interior of said mixer portion, and a hollow mixing shaft being coupled to said toothed flywheel, said open upper end being releasably coupled to said bottom end of said reservoir;

said mixing shaft of said mixer portion having a pair of first mixing fins, a pair of second mixing fins, and a pair of third mixing fins being extended therefrom for mixing cement in said interior of said mixer portion;

said mixing shaft of said mixer portion having a lumen, a first hole extending into said lumen and being positioned towards said second mixing fins, and a second hole extending into said lumen and being positioned towards said third mixing fins, said holes being for injecting air into said interior of said mixer portion;

a dispensing portion having open first and second ends, said first end of said dispensing portion being coupled to said lower end of said mixer portion, said second end of said dispensing portion having a hollow dispensing head coupled thereto, said hollow dispensing head having a slot therein;

a motor portion being in communication with said toothed flywheel, said motor portion being for rotating said toothed flywheel, said motor portion being driven by air;

a valve box being coupled to a supply of air pressure;

a first air tube extending between said valve box and said mixer portion, said first air tube being for selectively injecting air into said interior of said mixer portion towards said upper end of said mixer portion;

a second air tube extending between said valve box and said motor portion for providing air to said motor portion; and a third air tube extending between said valve box and said mixing shaft of said mixer portion, said third air tube being for selectively providing air to said lumen of said mixing shaft.

* * * * *